US005213680A

United States Patent [19]

Kremer et al.

[11] Patent Number: 5,213,680

[45] Date of Patent: May 25, 1993

[54] SWEETENING OF OILS USING HEXAMETHYLENETETRAMINE

[75] Inventors: Lawrence N. Kremer, The Woodlands; John Link, Humble; Glenn L. Roof, Sugar Land, all of Tex.

[73] Assignee: Baker Hughes Incorporated, Houston, Tex.

[21] Appl. No.: 812,118

[22] Filed: Dec. 20, 1991

[51] Int. Cl.[5] ..... C10G 29/20; C10G 29/00

[52] U.S. Cl. ..... 208/207; 208/189; 208/208 R; 208/236; 208/237

[58] Field of Search ..... 208/189, 207, 208 R, 208/236, 237

[56] References Cited

U.S. PATENT DOCUMENTS

| | | | |
|---|---|---|---|
| 4,202,882 | 5/1980 | Schwartz | 424/76.2 |
| 4,594,147 | 6/1986 | Roof et al. | 208/207 |
| 4,867,865 | 9/1989 | Roof | 208/236 |

*Primary Examiner*—Theodore Morris
*Assistant Examiner*—Walter D. Griffin
*Attorney, Agent, or Firm*—Rossenblatt & Associates

[57] ABSTRACT

Sour sulfhydryl-group containing oils are treated with an amount of hexamethylenetetramine effective to sweeten the oil and reduce headspace $H_2S$ to a desired level.

16 Claims, No Drawings

SWEETENING OF OILS USING HEXAMETHYLENETETRAMINE

BACKGROUND OF THE INVENTION

This invention relates to the treatment of "sour" petroleum and coal liquefaction oils containing hydrogen sulfide and other organosulfur compounds such as thiols and thiocarboxylic acids, and more particularly, to improved methods of treating such streams.

Petroleum and synthetic coal liquefaction crude oils are converted into finished products in a fuel products refinery, where principally the products are motor gasoline, distillate fuels (diesel and heating oils), and bunker (residual) fuel oil. Atmospheric and vacuum distillation towers separate the crude into narrow boiling fractions. The vacuum tower cuts deeply into the crude while avoiding temperatures above about 800° F. which cause thermal cracking. A catalytic cracking unit cracks high boiling vacuum gas oil into a mixture from light gases to very heavy tars and coke. In general, very heavy virgin residuum (average boiling points greater than 1100° F.) is blended into residual fuel oil or thermally cracked into lighter products in a visbreaker or coker.

Overhead or distillate products in the refining process generally contain very little, if any, hydrogen sulfide, but may contain sulfur components found in the crude oil, including mercaptans and organosulfides. However, substantial amounts of hydrogen sulfide, as well as mercaptans and organosulfides, are found in vacuum distillation tower bottoms, which may be blended into gas oils and fuel oils.

As employed in this application, "oil" is meant to include the unrefined and refined hydrocarbonaceous products derived from petroleum or from liquefaction of coal, both of which contain sulfur compounds. Thus, the term "oil" includes, particularly for petroleum based fuels, wellhead condensate as well as crude oil which may be contained in storage facilities at the producing field and transported from those facilities by barges, pipelines, tankers, or trucks to refinery storage tanks, or, alternatively, may be transported directly from the producing facilities through pipelines to the refinery storage tanks. The term "oil" also includes refined products, interim and final, produced in a refinery, including distillates such as gasolines, distillate fuels, fuel products, oils, and residual fuels.

Hydrogen sulfide which collects in vapor spaces above confined hydrogen sulfide containing oils (for example, in storage tanks or barges) is poisonous, in sufficient quantities, to workers exposed to the hydrogen sulfide. Refined fuels must be brought within sulfide and mercaptan specifications for marketability. In the processing of oils, it is desirable to eliminate or reduce atmospheric emissions of noxious hydrogen sulfide, mercaptan or other sulfhydryl compounds associated with sulfur containing oils, in order to improve environmental air quality at refineries.

Oils have been treated with caustic soda and chemicals to reduce hydrogen sulfide content. Because it is relatively inexpensive, caustic soda (sodium hydroxide) is commonly used to treat, up to a maximum sodium limit, the bunker fuels which principally are burned by utilities or ships. Excess sodium in bunker fuels forms inorganic products that cause undesirable ash, plugged burner tips and boiler slagging. Chemical treatments are necessary to further reduce $H_2S$ content of bunker fuels which have a sodium content at maximum limits.

Some distillates and fuel products such as gas oils and aviation fuels cannot be treated with caustic. Gas oils are a fuel intermediate fed to fluid catalatic crackers, and sodium poisons the catalysts in the catalytic crackers. Aviation fuel cannot be treated with caustic because the sodium gives inorganic products that foul engines. Asphalt products can't be treated with caustic because the caustic changes the physical properties of the product, for example, increasing the softening point. These oils are a fuel product of commerce bought and sold among refineries and transported by barge. Barge operators dislike transporting oil which has more than a minimal $H_2S$ content, because $H_2S$ vapor escaping from the fuel is life threatening. Treatment is necessary to reduce $H_2S$ to acceptable limits.

The prior art relating to the treatment of sour petroleum oils includes methods in which choline base has been employed to treat sour heavy fuel oils to maintain the hydrogen sulfide content in the atmosphere above or associated with such oils at levels within acceptable limits to avoid health hazards to personnel, as disclosed in U.S. Pat. No. 4,867,865. Choline base also has been used to treat gasoline and other motor fuels to remove organosulfur compounds such as thiols, thiolcarboxylic acids, disulfides and polysulfides, as disclosed in U.S. Pat. No. 4,594,147.

The use of choline base for these purposes is effective, but we have discovered a more effective treatment to reduce hazards of hydrogen sulfide exposure to workers, to bring fuels within hydrogen sulfide or mercaptan specifications, and to eliminate or reduce atmospheric emissions of noxious hydrogen sulfide, mercaptan or other sulfhydryl compound odors associated with such fuels for improved environmental air quality.

SUMMARY OF THE INVENTION

In accordance with this invention, a new method is provided for sweetening oils which contain at least hydrogen sulfide ($H_2S$) and may also contain organosulfur compounds having a sulfhydryl (—SH) group, also known as a mercaptan group, such as, thiols (R—SH, where R is hydrocarbon group), thiol carboxylic acids (RCO—SH), and dithio acids (RCS—SH). Such oils are treated with an effective sweetening and hydrogen sulfide vapor reducing amount of hexamethylenetetramine ("HMTA").

This new treating method is effective both on causticized and non-causticized oils. Thus, it may be used supplementally or entirely. It is particularly effective on residual fuels from heavy naphthenic crudes that are resistant to treatment with choline base, and is effective to treat to zero the $H_2S$ in a vapor space over a confined oil. The treatment is effective, indeed more effective, at higher temperatures than at mild temperatures, and may be employed up to temperatures at which the products produced by reaction of sulfhydryl groups and HMTA in turn decompose. HMTA begins to decompose at about 302° F., forming formaldehyde and ammonia. The formaldehyde itself is a sulfhydryl group scavenger, so loss of $H_2S$ vapor reducing power is not immediate at 302° F. Suitably treatment temperatures do not exceed about 350° F., preferably about 300° F., and may be conducted at ambient temperature, preferably about 100° F. and higher for ease of mixing.

Hexamethylenetetramine suitably may be produced by bubbling anhydrous ammonia into formalin, which is a 37% solution of formaldehyde in water. Six mols of formaldehyde react with four mols of ammonia to produce one mol of HMTA plus six mols of water. The reaction is exothermic and is suitably controlled by controlling rate of addition of anhydrous ammonia. Ambient temperatures and pressures are satisfactory. A slight excess of ammonia to formaldehyde, suitably 1.1:1, is used to assure complete reaction with formaldehyde. The product may be sparged with nitrogen to remove any excess ammonia. Suitably, for reasons principally of economy, a solution of HMTA in water is employed in the treatment of this invention, and a 40% solution is satisfactory.

HMTA may be used to reduce hydrogen sulfide vapor in vapor spaces above confined oils to acceptable limits by treating such oils with an effective hydrogen sulfide reducing amount of such compound. Such treatment is effective where the hydrogen sulfide level above the liquid petroleum hydrocarbon to be treated is between 10 ppm to 100,000 ppm(v). To reduce hydrogen sulfide in the vapor space above confined oils to within acceptable limits, preferably an amount of the HMTA directly proportional to the amount of hydrogen sulfide present in the vapor space is employed to treat the oil. Suitably from about 10 to about 10,000 ppm by weight of HMTA may be employed.

Such compounds may also be used to reduce noxious atmospheric odors of hydrogen sulfide, mercaptans and other sulfhydryl compounds from oils by treating such products with an effective odor reducing amount of such compounds. Such amounts are in direct proportion to the concentration of sulfhydryl groups in the oil.

To sweeten a hydrocarbon, the molar amount of HMTA added to the sour hydrocarbon is directly proportional to the molar amounts of hydrogen sulfide, mercaptans or other organosulfur compound(s) having a sulfhydryl group which are present in the hydrocarbon. For oils, HMTA suitably is mixed in the oil at temperatures at which the oil is flowable for ease of mixing until reaction with hydrogen sulfide or with sulfhydryl-containing organosulfur compounds has produced a product with sulfhydryls removed to an acceptable or specification grade oil product. HMTA is hydrophilic and high mix conditions are needed to distribute it or it in aqueous solution thoroughly in the oil to be treated. This preferably is done by metering it into the intake side of a pump when the oil is being pumped from one location to another, for example, to a storage tank or barge. Hydrogen sulfide contents of up to about 100,000 ppm in oil may be treated satisfactorily in accordance with this method. Suitably, from about 10 to about 10,000 ppm by weight of the HMTA is employed.

The following examples illustrate the use of HMTA employed to treat crude stocks laden with sulfides.

EXAMPLE 1

Aliquots of No. 6 fuel oil from a U.S. Gulf Coast crude were tested to determine the effectiveness of HMTA to reduce $H_2S$ headspace vapor in comparison to choline base as a treating agent.

To simulate $H_2S$ emissions from oil stored in tanks and barges, a 100 μL septum bottle is half filled with the $H_2S$ laden sample oil, quickly blanketed with nitrogen, and capped with a septum using a crimping tool. An $H_2S$ abatement additive is added to the fuel by a microliter liquid syringe needled through the septum. The bottle is placed in an oven and shaken to simulate pipeline transfer mixing and storage. A microliter syringe needle is then inserted through the septum and a gas sample is withdrawn from the vapor space and injected into a gas chromatograph (GC) having flame photometry detection (FPD) specific for sulfur compounds. In this way, hydrogen sulfide can be quantified in the 1 to 300,000 ppm range.

For headspace analysis, a $H_2S$ calibration curve is first generated for the GC/FPD detector system used (Hewlett Packard 5890A Gas Chromatograph and HP 19256a flame photometric detector) by injecting varying volumes of a certified $H_2S$ calibration gas with gas tight syringes. Vapor from oil sample bottles is removed through a gas tight syringe and the vapor sample or its dilution is injected into the GC. A J&W GSQ, 30 meter length, 0.53 mm I.D. (J&W #115-3432) column produces excellent resolution of hydrogen sulfide and other organosulfur compounds. Peak area for $H_2S$ is converted to ppm(v) concentration via the calibration curve.

Aliquots of the No. 6 fuel oil in three septum bottles were dosed with 50 μL of 10% NaOH solution and heated at 180° F. for two hours, then headspace vapor samples were taken and analyzed as described above. One bottle served as a blank. Another bottle was then dosed with 100 μL of choline base solution (40% solution of choline base in methanol) (1900 ppm by weight for this fuel sample) and heated at 180° F. in the oven with shaking for one hour, then a headspace vapor sample was taken and analyzed as described above. The third bottle was dosed with 100 μL of HMTA (40% aqueous solution) (2.310 ppm by weight [W]), heated at 180° F. in the oven with shaking for one hour, then a headspace vapor sample from it was taken and analyzed. Similarly, after one additional hour of heating at 180° F. with shaking, a headspace vapor sample from the aliquot blank was taken and analyzed. The three aliquots were then returned to oven shaking at 180° F., and vapor space samples were withdrawn and analyzed at hourly intervals twice more, then again after another 20 hours.

Thus, samples were taken from the three causticized aliquots (blank, choline base and HMTA) at plus one, plus two, plus three and plus 20 hours after the initial two hours causticizing treatment. The results are set forth in Table 1.

TABLE 1

$H_2S$ reduction from No. 6 fuel oil (Louisiana refinery) at 180° F. dosed with 50 μL of 10% NaOH solution and 100 μL of Choline Base or HMTA solution.

| Supplemental Treatment | Dosage (ppm-W) | Elapsed Time (Hours) | $H_2S$ (ppm-V) |
|---|---|---|---|
| Blank | 0 | 2 | 27,100 |
| " | 0 | +1 | 16,700 |
| " | 0 | +2 | 22,500 |
| " | 0 | +3 | 19,900 |
| " | 0 | +20 | 17,500 |
| Choline base | 0 | 2 | 25,400 |
| " | 1900 | +1 | 1,500 |
| " | 1900 | +2 | 2,200 |
| " | 1900 | +3 | 1,000 |
| " | 1900 | +20 | 2,100 |
| HMTA | 0 | 2 | 22,500 |
| " | 2310 | +1 | 12,700 |
| " | 2310 | +2 | 11,300 |
| " | 2310 | +3 | 3,800 |
| " | 2310 | +20 | 53 |

As may be seen from Table 1, the HMTA solution reacted much slower than the choline solution, but gave a lower ultimate treat level after 20 hours. This slower apparent reaction rate may be due to mixing and the hydrophilic nature of the HMTA, for the $H_2S$ would have to diffuse to and dissolve in the water droplets containing HMTA to react.

EXAMPLE 2

The same procedure was followed as for Example 1, except the three aliquots were not causticized. The results are set forth in Table 2.

TABLE 2

$H_2s$ reduction from No. 6 fuel oil (Louisiana refinery) at 180° F. not dosed with caustic and dosed with choline base or HMTA

| Supplemental Treatment | Dosage (ppm-W) | Elapsed Time (Hours) | $H_2S$ (ppm-V) |
|---|---|---|---|
| Blank | 0 | 2 | 28,200 |
| " | 0 | +1 | 24,400 |
| " | 0 | +2 | 29,800 |
| " | 0 | +3 | 24,200 |
| " | 0 | +20 | 25,300 |
| Choline base | 0 | 2 | 25,400 |
| " | 1940 | +1 | 9,300 |
| " | 1940 | +2 | 7,900 |
| " | 1940 | +3 | 6,300 |
| " | 1940 | +20 | 4,200 |
| HMTA | 0 | 2 | 23,000 |
| " | 2550 | +1 | 11,400 |
| " | 2550 | +2 | 12,700 |
| " | 2550 | +3 | 2,800 |
| " | 2550 | +20 | 25 |

Comparison of Tables 1 and 2 shows that causticizing the oil does not make any apparent difference in the results obtained.

EXAMPLE 3

The same methodology of heat aging, sampling and analysis was followed for this example as for Example 1, except as follows: The No. 6 fuel oil was made from heavy California crudes. Initial heat aging after causticizing was for one hour. After dosing with choline base or HMTA followed by an hour of heat aging and then vapor sampling, additional (cumulative) dosing was done in two 50 μL steps. Heating, aging and sampling occurred between the steps. The dosages and their ppm equivalents for the particular fuel sample densities follow for the elapsed time periods:

TABLE 3A

| Cumulative (μL) | Dosages and ppm equivalents: Choline Base (ppm-W) | HTMA (ppm-W) | Elapsed Time (hr.) |
|---|---|---|---|
| 0 | 0 | 0 | 1 |
| 40 | 624 | 944 | +1 |
| 90 | 1400 | 2120 | +2 |
| 140 | 2180 | 3300 | +3 |
| 140 | 2180 | 3300 | +20 |

The results follow in Table 3B.

TABLE 3B $H_2S$ reduction from No. 6 fuel oil (California refinery) at 180° F. treated with caustic and various dosage levels of choline base or HMTA solution.

| Cumulative Dosage (μL) | Elapsed Time (hr.) | $H_2S$ (ppm-V) Blank | Choline base | HMTA |
|---|---|---|---|---|
| 0 | 1 | 32,000 | 28,100 | 31,000 |
| 40 | +1 | 27,300 | 17,900 | 29,800 |

TABLE 3B-continued $H_2S$ reduction from No. 6 fuel oil (California refinery) at 180° F. treated with caustic and various dosage levels of choline base or HMTA solution.

| Cumulative Dosage (μL) | Elapsed Time (hr.) | $H_2S$ (ppm-V) Blank | Choline base | HMTA |
|---|---|---|---|---|
| 90 | +2 | 39,700 | 29,700 | 20,500 |
| 140 | +3 | 37,200 | 29,500 | 5,000 |
| 140 | +20 | 37,700 | 24,100 | 274 |

In this fuel oil, headspace $H_2S$ increased with time, and while the choline base treatment was effective to prevent as much rise in $H_2S$ vapor as without it, the HMTA was much more effective, reducing $H_2S$ to a very low ultimate treat level.

EXAMPLE 4

In this example, the same general procedures were followed as above, using the same type causticized fuel oil as for Example 3, at the final 140 μL HMTA dosage level in Example 3, but in comparison to higher choline base dosages for the same heat aging periods. In the HMTA tests, vapor space was tested 1, 3 and 5 hours after HMTA was injected. In the choline base test, vapor space was tested after 3 hours from injection, then an additional 100 μL was injected, and then after another 2 hours vapor space was tested. The results are set forth in Table 4.

TABLE 4

$H_2S$ reduction from No. 6 fuel oil (California refinery) at 180° F. Treated with caustic and HMTA compound to higher dosages of choline base over same time period.

| Supplemental Treatment | Cumulative Dosage (ppm-W) | Elapsed Time (Hours) | $H_2S$ (ppm-V) |
|---|---|---|---|
| HMTA | 0 | 0 | 12,800 |
| " | 3300 | 1 | 11,500 |
| " | 3300 | 3 | 3,900 |
| " | 3300 | 5 | 980 |
| Blank | 0 | 0 | 26,600 |
| " | 0 | 3 | 27,100 |
| " | 0 | 5 | 23,200 |
| Choline base | 0 | 0 | 19,600 |
| " | 2960 | 3 | 18,300 |
| " | 4520 | 4 | 23,200 |

This shows that HMTA treatment of this oil at 3300 ppm is more effective than choline base treatment of the same oil at higher dosages.

EXAMPLE 5

In this example, the same general procedures and oil as for Examples 3 and 4 were employed, except only HMTA was tested. Two aliquots of the causticized oil were aged at 140° F. (not 180° F. as in the preceding examples). After one hour and two hour headspace samplings, 50 μL (1215 ppm-W) of HMTA was injected into one aliquot and headspace was sampled after one hour. Then another 50 μL HMTA was injected, and the aliquot then was incubated for an hour, then sampled. The aliquot then was incubated overnight and sampled. Another 50 μL HMTA was added, and the aliquot was heat aged another hour and sampled. Then the aliquot was heat aged for four more days and sampled. The results are set forth in Table 5.

TABLE 5

$H_2S$ reduction from causticized No. 6 fuel oil (California refinery) @ 140° F. dosed with progressively higher levels of HMTA.

| Dosage (ppm-W) | Elapsed Time | $H_2S$ (ppm-V) Blank | HMTA |
|---|---|---|---|
| 0 | Day 1, 1 hr. | 6,200 | 8,900 |
| 0 | Day 1, 3 hrs. | 10,700 | 11,300 |
| 1215 | Day 1, +1 hr. | 12,900 | 10,000 |
| 2430 | Day 1, +2 hrs. | 13,400 | 5,900 |
| 2430 | Day 2 | 17,500 | 8,300 |
| 3645 | Day 2, +1 hr. | 22,200 | 9,300 |
| 3645 | Day 6 | 13,900 | 0 |

The results show that HMTA was effective at low dosages to reduce $H_2S$ in the vapor space and, at sufficiently high dosages for this oil, was effective to eliminate $H_2S$ from the vapor space.

EXAMPLE 6

In this example, the aliquot in Example 6 that was treated to zero $H_2S$ was slowly heated at increasing temperatures to 180° F., without appreciable release of $H_2S$, as seen in Table 6.

TABLE 6

Release of $H_2S$ from HMTA treated sample from Example 5 heated over several days at progressively higher temperatures.

| Temperature (°F.) | Elapsed Time (Days) | (Hrs.) | $H_2S$ (ppm-v) |
|---|---|---|---|
| 140 | Day 6 | 0 | 0 |
| 160 | Day 6 | 3 | 0 |
| 160 | Day 7 | — | 12 |
| 180 | Day 7 | 4 | 11 |
| 180 | Day 8 | — | 18 |

EXAMPLE 7

The method of Example 5 was conducted on the same oil type but with heat aging at 250° F. instead of 140° F. The results are set forth in Table 7.

TABLE 7

$H_2S$ reduction from causticized No. 6 fuel oil (California) at 250° F. dosed with progressively higher levels of HMTA.

| Cumulative Dosage (ppm-W) | Elapsed Time (Days) | $H_2S$ (ppm-V) Blank | HMTA |
|---|---|---|---|
| 0 | Day 1, 1 hr. | 12,300 | 12,300 |
| 0 | Day 1, 3 hrs. | 21,500 | 15,900 |
| 1200 | Day 1 | 24,100 | 15,600 |
| 2400 | Day 1 | 26,000 | 9,100 |
| 2400 | Day 2 | 46,700 | 1,600 |
| 3600 | Day 2 | 51,800 | 84 |
| 3600 | Day 6 | 29,300 | 0 |

Table 7 shows that HMTA is effective to treat to zero $H_2S$ in oil at 250° F., even more effectively than at 140° F.

Having now described our invention, variations, modifications and changes within the scope of our invention will be apparent to those of ordinary skill in the art, and are intended to be included within the scope of the following claims.

What is claimed is:

1. A method of sweetening sour hydrocarbon oils, which comprises treating said hydrocarbon oils with an effective sweetening amount of hexamethylenetetramine.

2. A method of reducing hydrogen sulfide vapor in a vapor space above a confined sour hydrocarbon oil which comprises treating such hydrocarbon oil with an effective hydrogen sulfide quantity reducing amount of hexamethylenetetramine.

3. The method of claim 2 in which the amount of said hexamethylenetetramine is directly proportional to the amount of hydrogen sulfide present in said vapor space.

4. The method of claim 2 in which the amount of hydrogen sulfide present in said vapor space is from 10 to 100,000 ppm by volume.

5. The method of claim 2 in which the hydrocarbon is treated at a temperature from about 100° F. to about 350° F.

6. The method of claim 2 in which the treating amount of hexamethylenetetramine is from about 10 to about 10.000 ppm by weight.

7. The method of reducing noxious odors of hydrogen sulfide, mercaptans and other sulfhydryl compounds in the atmosphere from a sour hydrocarbon oil which comprises treating said sour hydrocarbon oil with an effective odor reducing amount of hexamethylenetetramine.

8. A method of sweetening sour hydrocarbon oils, which comprises treating said hydrocarbon oils at a temperature from about 100° F. to about 350° F. with an effective sweetening amount of hexamethylenetetramine.

9. A method of sweetening sour hydrocarbon oils, which comprises treating said hydrocarbon oils at a temperature from about 180° F. to about 350° F. with an effective sweetening amount of hexamethylenetetramine.

10. A method of sweetening sour hydrocarbon oils, which comprises treating said hydrocarbon oils with an amount of hexamethylenetetramine which is directly proportional to the sulfhydryl content of said hydrocarbon oil.

11. A method of sweetening sour hydrocarbon oils, which comprises treating said hydrocarbon oils with about 10 to about 10,000 ppm by weight of hexamethylenetetramine.

12. A method of reducing hydrogen sulfide vapor in a vapor space above a confined sour hydrocarbon oil, which comprises treating such hydrocarbon oil with an amount of hexamethylenetetramine which is directly proportional to the amount of hydrogen sulfide present in said vapor space.

13. A method of reducing about 10 to about 100,000 ppm of hydrogen sulfide vapor in a vapor space above a confined sour hydrocarbon oil, which comprises treating such hydrocarbon oil with an effective hydrogen sulfide quantity reducing amount of hexamethylenetetramine.

14. A method of reducing hydrogen sulfide vapor in a vapor space above a confined sour hydrocarbon oil, which comprises treating such hydrocarbon oil at a temperature from about 100° F. to about 350° F. with an effective hydrogen sulfide quantity reducing amount of hexamethylenetetramine.

15. A method of reducing hydrogen sulfide vapor in a vapor space above a confined sour hydrocarbon oil, which comprises treating such hydrocarbon oil at a temperature from about 180° F. to about 350° F. with an effective hydrogen sulfide quantity reducing amount of hexamethylenetetramine.

16. A method of reducing hydrogen sulfide vapor in a vapor space above a confined sour hydrocarbon oil, which comprises treating such hydrocarbon oil with about 10 to about 10,000 ppm by weight of hexamethylenetetramine.

* * * * *